United States Patent [19]

Becker

[11] Patent Number: 4,660,731

[45] Date of Patent: Apr. 28, 1987

[54] TELESCOPIC CRANE FOR HEAVY LOADS

[75] Inventor: Rudolf Becker, Ehingen/Donau, Fed. Rep. of Germany

[73] Assignee: Liebherr-Werk Ehingen GmbH, Ehingen/Donau, Fed. Rep. of Germany

[21] Appl. No.: 637,209

[22] Filed: Aug. 3, 1984

Related U.S. Application Data

[63] Continuation-in-part of Ser. No. 429,320, Sep. 30, 1982, abandoned.

[30] Foreign Application Priority Data

Oct. 5, 1981 [DE] Fed. Rep. of Germany ..... 3139596

[51] Int. Cl.[4] ..... B66C 23/26; B66C 23/44; B66C 23/78

[52] U.S. Cl. ..... 212/175; 212/180; 212/182; 212/189; 212/211; 212/230; 212/264; 212/265; 212/267

[58] Field of Search ..... 212/175–176, 212/178–182, 189, 211, 227, 230–232, 238, 255, 261, 264, 265, 267

[56] References Cited

U.S. PATENT DOCUMENTS

| | | | |
|---|---|---|---|
| 3,362,544 | 1/1968 | Wellnitz | 212/189 |
| 3,734,223 | 5/1973 | Anderson | 212/182 |
| 4,053,061 | 10/1977 | Lester | 212/165 |
| 4,082,191 | 4/1978 | Whittingham | 212/238 |

FOREIGN PATENT DOCUMENTS

| | | | |
|---|---|---|---|
| 723474 | 12/1965 | Canada | 212/182 |
| 2007837 | 10/1970 | Fed. Rep. of Germany | 212/165 |
| 2253068 | 7/1973 | Fed. Rep. of Germany | 212/223 |
| 2300643 | 7/1974 | Fed. Rep. of Germany | 212/182 |

*Primary Examiner*—Sherman D. Basinger
*Assistant Examiner*—R. B. Johnson
*Attorney, Agent, or Firm*—Fleit, Jacobson, Cohn & Price

[57] ABSTRACT

A separate boom vehicle is provided for transporting a telescopic boom, which is adapted to be coupled to a revolving superstructure and to be detached from it for transporting. The boom vehicle is provided in its forward portion with a coupling structure for retaining a telescopically extensible part of the telescopic boom, and is provided in its rear portion with a lifting structure for supporting the boom. The lifting structure is so arranged that when it has been longitudinally aligned with the revolving superstructure, a coupling yoke, provided at the lower end of the telescopic boom, is adapted to be displaced by extending and retracting cylinders along tracks provided on the revolving superstructure to a position in which bearing eyes of the telescopic beam register with bearing bores of the revolving superstructure. The revolving superstructure is provided with a pivot pin for coupling the boom to the revolving superstructure.

5 Claims, 10 Drawing Figures

TELESCOPIC CRANE FOR HEAVY LOADS

This application is a continuation-in-part application of U.S. patent application Ser. No. 429,320 filed Sept. 30, 1982, now abandoned.

This invention relates to a mobile crane comprising a crane chassis, a revolving superstructure and a telescopic boom.

In known self-propelled cranes, the telescopic boom is always connected to a revolving superstructure of the crane to form a mobile unit therewith so that there is no need for an operation by which the parts are coupled for use, as is usual, e.g., with construction cranes. Because the known self-propelled cranes are transported as a unit, their size is limited by the highest total weight which is permissible for road transportation. For this reason the largest self-propelled cranes, comprising eight-axle crane vehicles, have a total weight of about 96 metric tons. The maximum load-carrying capacities of these self-propelled telescopic cranes, which are transported as a unit, are about 200 to 250 metric tons. Such cranes transported as a unit cannot be appreciably increased in size because this would involve a weight in excess of the highest weights which are permissible for transportation on roads.

It is an object of the present invention to provide a mobile crane which is of the kind described first heretobefore and which has a higher load-carrying capacity or is capable of exerting a higher load moment but does not have a weight in excess of the maximum weight that is permissible for transporting on roads and which can also quickly be brought to an operative condition.

This object is accomplished in accordance with the invention in that a separate boom vehicle is provided for transporting the telescopic boom, which is adapted to be coupled to the revolving superstructure and to be detached from it for transporting. The boom vehicle is provided in its forward portion with coupling means for retaining a telescopically extensible part of the telescopic boom, and is provided in its rear portion with a lifting structure for supporting the boom. The lifting structure is so arranged that when it has been longitudinally aligned with the rotating deck or the revolving superstructure, the coupling yoke provided at the lower end of the coupling yoke of the telescopic boom is adapted to be displaced by extending and retracting cylinders along tracks provided on the revolving superstructure to a position in which the bearing eyes of the coupling yoke of the telescopic boom register with the bearing bores of the boom bearing of the revolving superstructure. The revolving superstructure is provided with means for inserting and retracting the pivot pin for coupling the boom to the revolving superstructure. The mobile crane in accordance with the invention can be designed to have a load-carrying capacity in excess of 400 metric tons when the crane is assembled whereas the advantages residing in the crane being transported on roads quickly and in a simple manner and can quickly be brought to an operative condition need not be sacrificed.

Because the telescopic boom is transported by a separate boom vehicle, the assembled crane may have a much heavier total weight. The mobile crane in accordance with the invention can be brought to an operative condition within about 20 minutes. It is sufficient to connect cylinders for extending and retracting the telescopic boom, which lie on the boom vehicle, to the appropriate lines of the crane vehicle. As an extending and retracting cylinder is extended, the coupling yoke is displaced along suitable slide tracks to a position in which it can be coupled to the revolving superstructure and is then preferably automatically coupled by means of a pin.

In a particularly desirable embodiment, a slidable plate is pivoted to the coupling yoke of the boom on the pivotal axis of the boom and carries a diesel engine, hydraulic pumps, a main winch, and tanks for hydraulic liquid are secured to the lower, outer part of the telescopic boom. In this embodiment of the invention, the telescopic boom, the diesel engine and the hydraulic pump constitute a self-contained unit so that it is sufficient to start the diesel engine when the lower part of the telescopic boom is to be extended to the position in which it can be coupled to the revolving superstructure whereas special supply lines need not be connected to the crane vehicle. Because the plate that is pivoted to the boom carries also the main winch, it is not necessary to unreeve the lifting ropes and the block. As the hydraulic equipment associated with the telescopic beam is transported together with said boom, the weights will be more evenly distributed on the two vehicles during road transportation. For this purpose, such mobile crane can be designed for a still higher load-carrying capacity.

As the platelike counterweights are transported by an additional vehicle, the load on the remaining vehicles for road transportation is further reduced. When the boom has been coupled to the revolving superstructure on the crane vehicle, the boom can be luffed by means of the luffing cylinders in such a manner that the mobile crane itself can take the counterweight plates from the vehicle by which they are carried.

The crane vehicle is so designed that it can be moved on a building site over short distances even when the crane has been fully assembled. Whereas the axle pressures which then occur are not permissible for transportation on roads, they will not be detrimental to the mobile crane.

In the mobile crane in accordance with the invention, the boom assembly can be installed and removed quickly without a need for heavy and time-consuming manual work. In dependence on the terrain, the parts of the crane can be assembled and the crane can be put into operation within about half an hour or a shorter time so that a self-propelling telescopic crane has been provided which can readily be put into operation.

Whereas the main winch is mounted on the plate which is connected to the boom, another winch may be provided between the arms of the coupling yoke of the boom. This additional winch may be used during an operation using two hooks or as a luffing winch if a luffable auxiliary boom has been attached.

An illustrative embodiment of the invention will now be explained more fully with reference to the drawing, in which FIG. 1 is a side elevation showing an eight-axle crane vehicle with the revolving superstructure before the boom is coupled;

Figure 1:
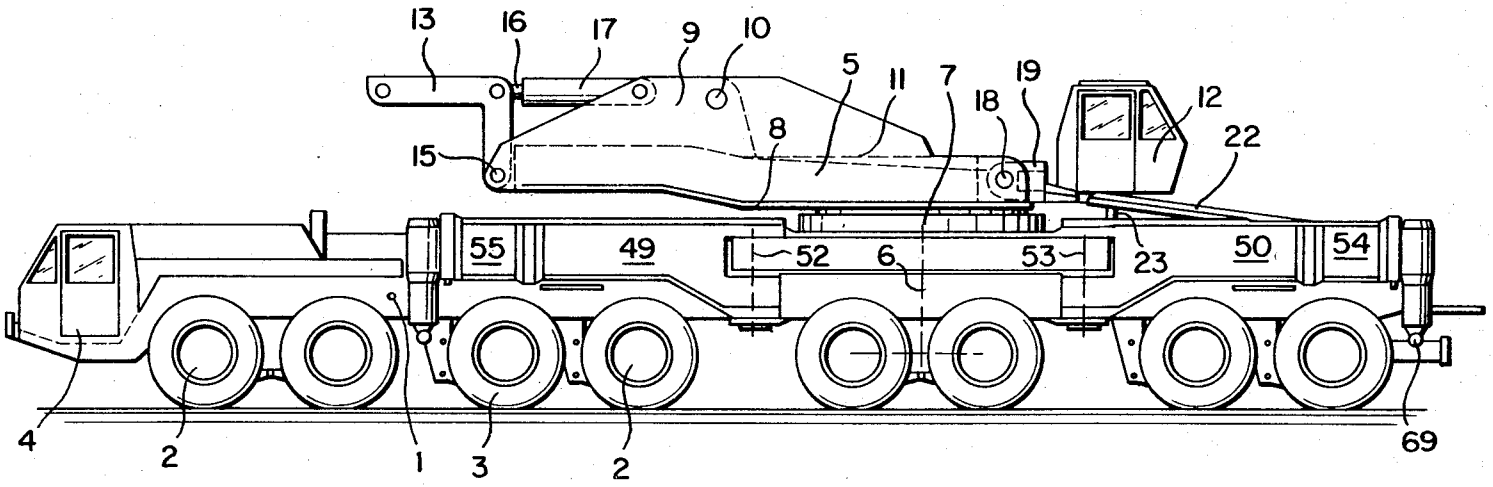

In the embodiment shown in FIGS. 1 to 7, the undercarriage of the telescopic crane consists of a crane vehicle comprising a chassis 1, which consists of structural steel sections and carries eight axles 2 arranged in pairs. All axles are provided with rubber-tired wheels 3 and are steerable. Four of the axles are driven. The diesel engine for propelling the crane vehicle is mounted behind the driver's cab 4 and serves to operate the hydraulic struts of the crane vehicle and the travel drive. As the parts of the crane are assembled, a slewing mechanism for the revolving superstructure 5 can be driven by means of a hydraulic pump, which is driven by the diesel engine.

The revolving superstructure 5 is mounted on the chassis 1 in known manner for rotation about the vertical axis 6 and is provided with a gear 7 in mesh with a pinion, which is driven by the rotary hydraulic motor of the slewing mechanism.

The revolving superstructure 5 comprises a platform 8, which is provided with side cheeks 9. The cheeks 9 are provided in their intermediate portions with aligned bores 10. The telescopic boom is adapted to be pivotally connected to the revolving superstructure 5 by means of pins, which are adapted to be inserted through the bores 10 by means of fluid-actuated cylinder-piston units, not shown. Guide rails form side tracks 11 at the top of the sides of the cheeks 9 on the inside thereof, which are indicated by dotted lines in FIG. 1. A crane operator's cab 12 is connected to the revolving superstructure 5 by a pivoted parallel crank linkage or by telescopically extensible linkages, and said linkage or linkages are adapted to be swung out or extended by fluid-actuated cylinder-piston units, not shown.

An angled davit 13 is mounted on the rear portion of the revolving superstructure 5 for rotation about the axis 15 and serves to carry counterweight plates 14. A piston rod 16 of a fluid-actuated cylinder-piston unit is pivoted to the davit 13 adjacent to the knee thereof and comprises a cylinder 17 which is pivoted between the cheeks 9 of the revolving superstructure 5.

A sleeve 19 is mounted on the forward portion of the revolving superstructure for rotation about the axis 18 and serves to receive and to be coupled to the piston rod 20 of the luffing cylinder 21, which is pivoted to the telescopic boom.

A ramp plate 22 is pivoted to the rear portion of the chassis 1 for rotation about a transverse axis, not shown, and is adapted to be lifted and lowered like a rocker by a fluid-actuated cylinder-piston unit 23. When the ramp plate 22 has been raised to the position shown in FIG. 1, it constitutes a slide ramp for the rear end of the boom of the sledge which is pivoted to said boom and will be described more in detail hereinafter. When the boom has been coupled, the ramp plate is moved to its inoperative position below the revolving superstructure 5.

Figure 2:
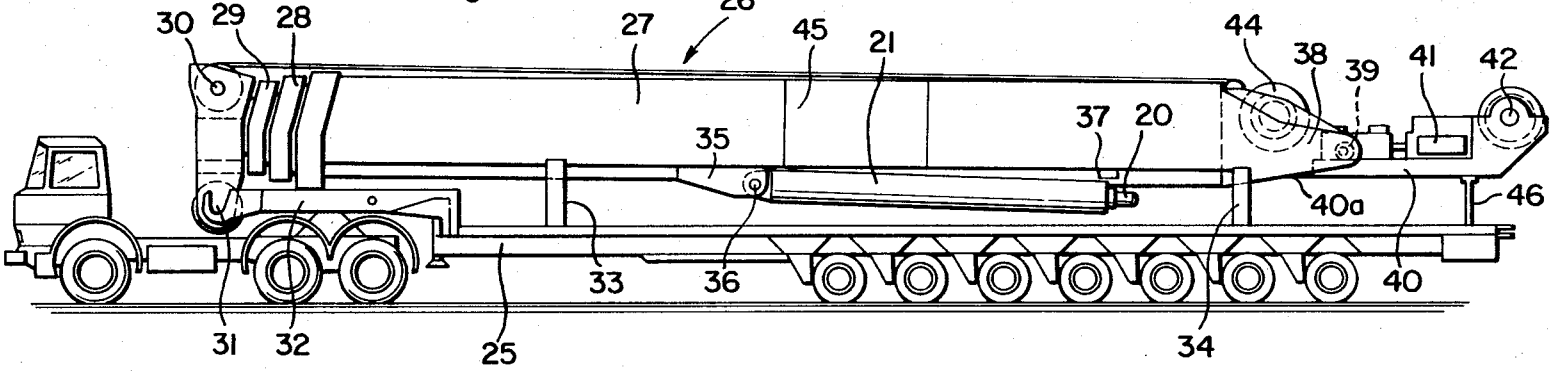
FIG. 2 is a side elevation of the boom vehicle carrying the retracted telescopic boom.

The boom vehicle shown in FIG. 2 constitutes a tractor and a semitrailer having a low-level deck 25, which carries the retracted telescopic boom 26. The latter consists of three parts 27, 28, 29, which are telescopically movable relative to each other. The innermost telescoped part 29 is provided at its top end with rollers, which are mounted on parallel axles 30, 31. The protruding ends of the axle 31 are hung into recesses formed in forked brackets 32, which are connected to the low-level deck 25. The outer telescoped part 27 of the telescopic boom 26 is supported and held on the low-level deck 25 by struts 33, 34. The strut 34 constitutes also a lifting structure. The outer telescoped part 27 is also provided on its underside with a bearing member 35, in which the luffing cylinder 21 is mounted for rotation about the axis 36. In position for transportation, shown in FIG. 2, the piston rod 20 has been retracted into the luffing cylinder 21 and the latter is held by the locking device 37 in a position in which the cylinder 21 is approximately parallel to the boom.

A sledge-like plate 40 is mounted between the yoke or laterally disposed bearing cheeks 38 for the outer telescoped part 27 for rotation about the pivot 39. When said sledge-like plate is approximately parallel to the axis of the telescopic boom 26, the plate 40 bears on a stop 40*a*, which is provided on the outer telescoped part 27 and permits a pivotal movement of the plate 40 only in an upward direction. The pivot 39 for the plate 40 is aligned with the bores 10 by which the telescopic boom 26 is coupled to the revolving superstructure.

The plate 40 carries a diesel engine 41, which serves to drive hydraulic pumps 43, which are also mounted on the plate 40 and drive the winches 42 and 44 and supply hydraulic oil to all hydraulically actuated means of the crane during the operation of the latter.

The main lifting winch 44 is mounted between the side cheeks 38 and is driven by a rotary hydraulic motor.

Tanks 45 are attached to opposite sides of the outer telescoped part 27 and are adapted to hold about 1000 to 2000 liters hydraulic oil each.

In a position for transporting, shown in FIG. 2, the sledge-like plate 40 is supported on the low-level deck 25 by the support 46.

The tractor and the semitrailer comprising the low-level deck 25 of the boom vehicle are of conventional type and are therefore not described more in detail.

Figure 5:
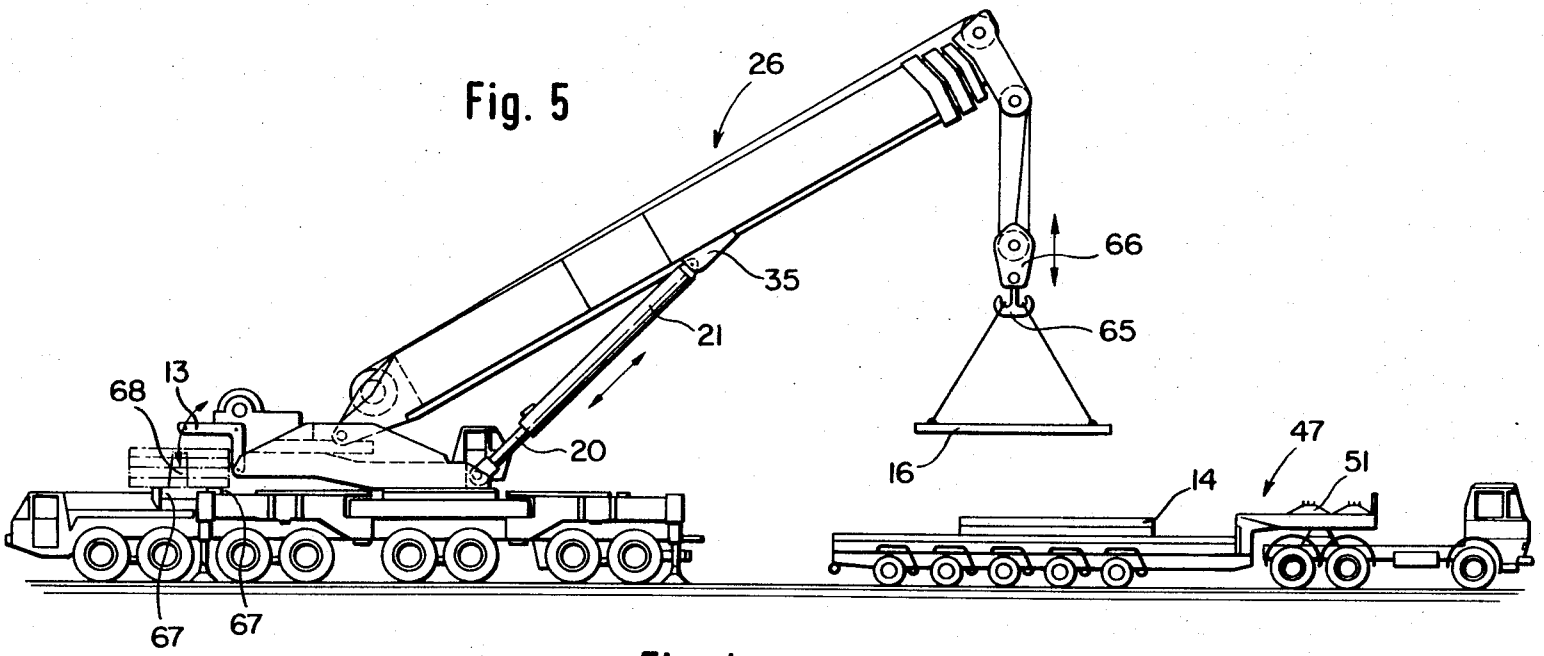
FIG. 5 is a side elevation showing the crane vehicle with the coupled telescopic boom during the unloading of the vehicle which carries the counterweights.

To ensure that excessive loads will not be applied to the axles of the crane vehicle shown in FIG. 1 during road transportation, the telescopic boom 26 is transported by the boom vehicle shown in FIG. 2 and the counterweight plates 14 are transported by the counterweight vehicle 47 shown in the right-hand part of FIG. 5. The counterweight vehicle 47 consists also of a conventional tractor and low-level trailer.

Figure 6:
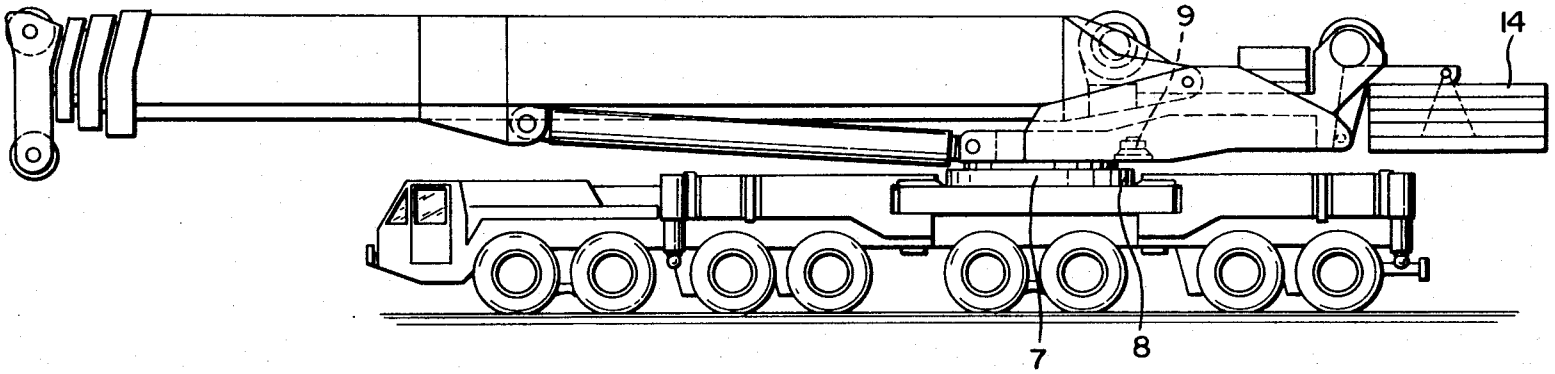
FIG. 6 is a side elevation showing the crane vehicle and the coupled boom in a travel position.
Figure 7:
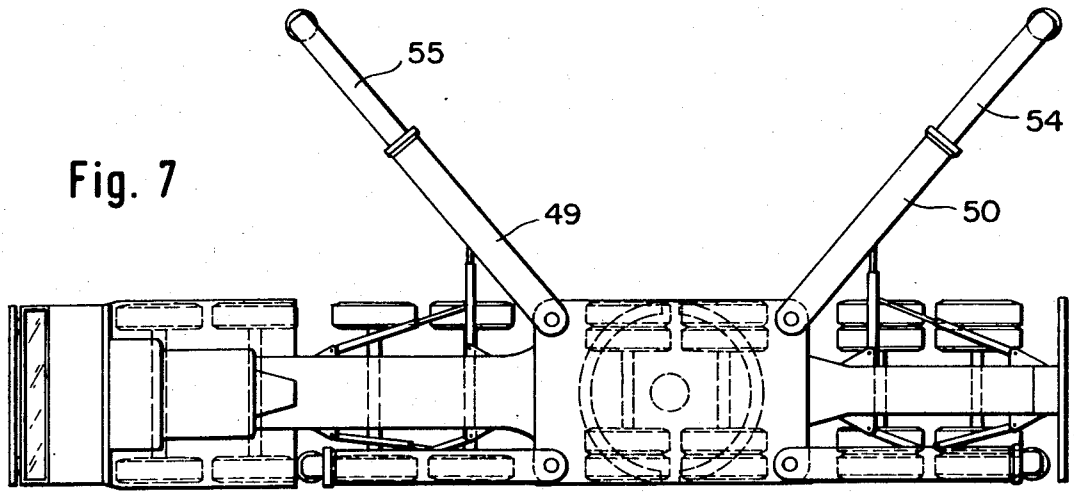
FIG. 7 is an underside view showing the crane vehicle with extended foldable telescopic struts.

The crane vehicle shown in FIG. 5 is so designed that the completely assembled crane shown in FIG. 6 can travel on a building site. Each axle is capable of taking up a load of 12 metric tons so that the total load on eight axles may amount to 96 tons. This is the weight of the crane without the boom and counterweights.

The coupling of the boom 26 to the revolving superstructure 5 will now be described more in detail with reference to FIG. 3. The crane vehicle and the boom vehicle are first backed toward each other on a planar surface so that they are longitudinally aligned, as shown. Both vehicles are then coupled by means of a coupling rod 48. As is apparent from FIG. 3, the arms 49, 50 may then be swung out and the legs 51 are extended against the ground. A coupling of the two vehicles is not essential but will facilitate the aligning.

The arms 49, 50 are pivoted to the undercarriage on axles 52, 53 as is shown in FIG. 1 and during transporting extend along the chassis 1 and are locked to the same. The arms 49, 50 have telescopically extensible parts 54, 55, which at their forward ends carry the legs 51, the telescopically extensible parts being extensible against the ground.

Figure 3:
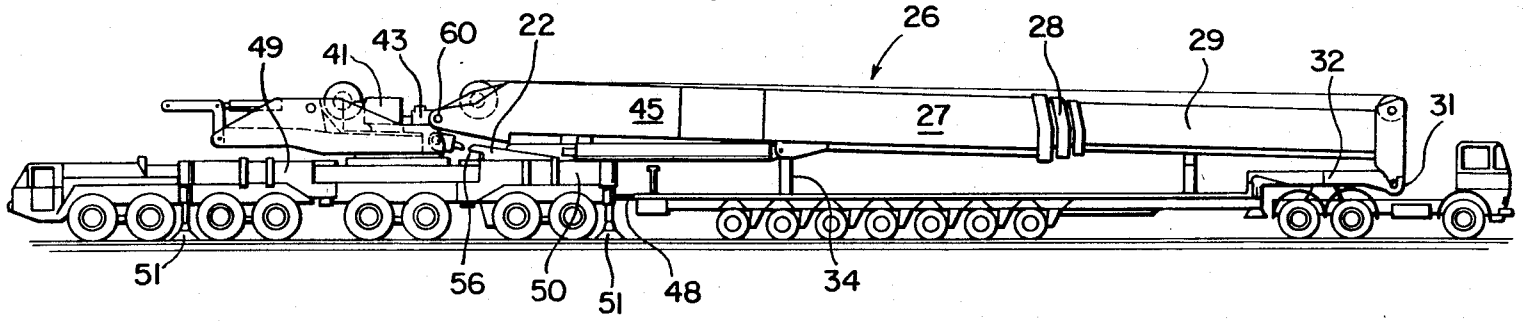
FIG. 3 shows in side elevation the crane vehicle of FIG. 1 and the boom vehicle of FIG. 2 during the coupling of the boom.
Figure 4:
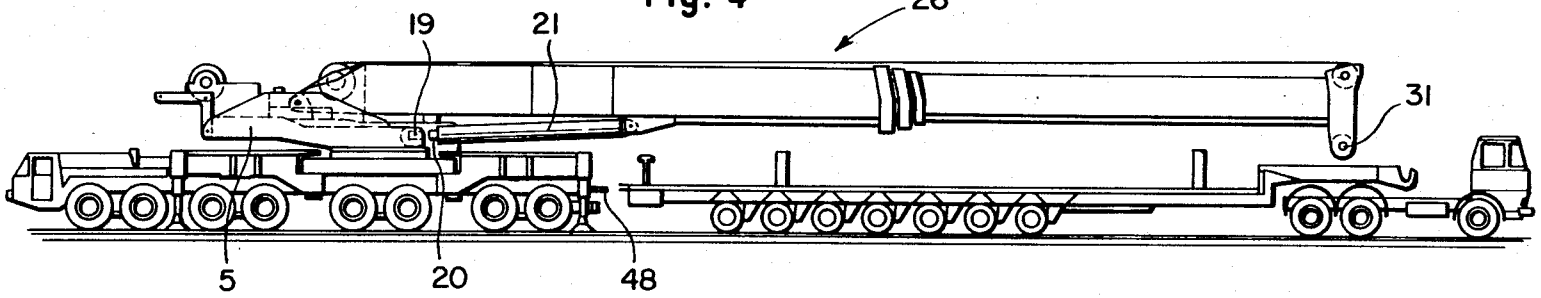
FIG. 4 shows in side elevation the vehicles shown in FIG. 3 after the boom has been coupled.

When the crane vehicle and the boom vehicle have thus been aligned, the lifting cylinder 23 is operated to pivotally raise the ramp plate 22 to the position shown in FIGS. 1 and 3 so that said plate constitutes a sloping ramp for the sledge-like plate 40. The lifting structure 34 is then raised to raise also the rear end of the boom 26. When the plate 40 is approximately aligned with the boom 26, the end edge of the plate 40 bears against the boom 26 so that the plate 40 cannot turn down and is raised too. As soon as the rear end of the boom 26 has been raised to a sufficiently high level, the diesel engine 41 is started and the hydraulic pump 43 is operated to supply hydraulic oil to the cylinder for extending and retracting the inner telescoped part 29, which is now extended to the position shown in FIG. 3. The hydraulic oil to be supplied to the extending and retracting cylinder is taken from the lateral tanks 45. Because the inner telescoped part 29 is held in position in the forked brackets 32 by the pivot 31, the intermediate and outer telescoped parts 27, 28 are extended from the boom vehicle beyond its rear end. During that operation the sledgelike plate 40 engages the sloping ramp plate 22 of the crane vehicle and is raised on the ramp plate 22. When the side edges of the plate 40 are displaced beyond the ramp plate 22, said side edges engage the tracks 11 carried by the cheeks 9 on the inside and are advanced on the latter. The plate 40 and/or the lower end of the outer telescoped part 27 may be provided with rollers for reducing the friction during the displacement on the slide tracks 11. The inner telescoped part 29 is extended until the bearing eyes 60 are aligned with the bearing bores 10 in the side cheeks 9 of the revolving superstructure 5. As soon as said alignment has been achieved, locking pivot pins, not shown, are extended by hydraulic cylinders through the bearing bores 10 and through the bearing eyes 60 of the lower telescoped part 27. The parts locked in said end position are shown in FIG. 4. In that position the plate 40 has been advanced as far as to the rear end portion of the revolving superstructure 5 and the piston rod 20 of the luffing cylinder 21 has been inserted into and locked in the sleeve 19. The piston rod 20 of the luffing cylinder 21 can now be extended to luff the boom 26 so that the pivot pins 31 can be disengaged from the forked bracket on the boom vehicle. When the coupling rod 48 has been detached from the cooperating coupling member of the boom vehicle, the latter can be moved away from the crane vehicle.

To bring the crane to a condition for operation, the counterweight vehicle 47 is moved to the position shown in FIG. 5 and the counterweight plates 14 are unloaded from the vehicle 47 by the crane itself when the boom parts are telescopically retracted. The luffing of the boom 26 is effected only by the luffing cylinder 21. The block may remain in a reeved condition, if desired.

When the bottom block 66 has been properly reeved, the counterweight plates 14 are hung on the crane hook 65 and are first placed on suitable supports 67 of the crane vehicle until the counterweight plates have been stacked to the desired height. The harness 68 carrying the counterweight plates is then connected to the outer end of the davit 13. As soon as this has been effected, the crane is ready for operation and, in the manner shown in FIG. 6, can travel on a building site to the desired location.

The counterweight vehicle 47 serves also to transport the legs 51, which are connected to the extensible piston rods 54 and 55 of the pivoted supporting arms 49, 50.

Figure 10:
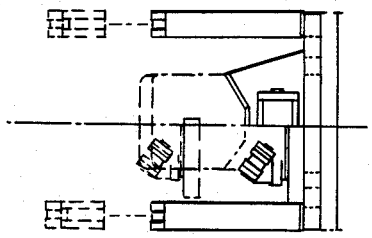
FIG. 10 is a rear elevation, partly in section, showing the low-level deck of the boom vehicle with the boom-lifting structure shown in FIG. 8.
Figure 8:
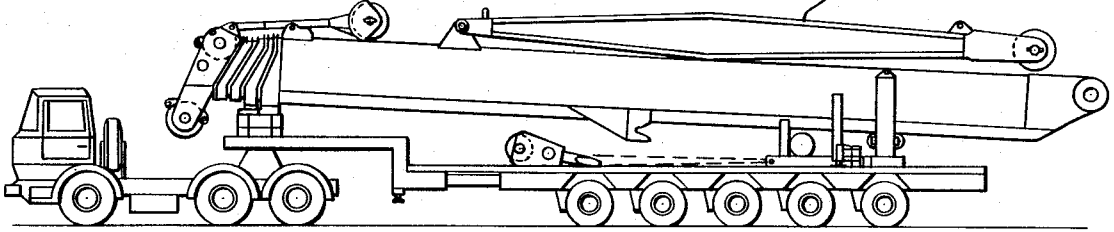
FIG. 8 is a side elevation showing a boom vehicle provided with a different embodiment of a telescopic boom.
Figure 9:
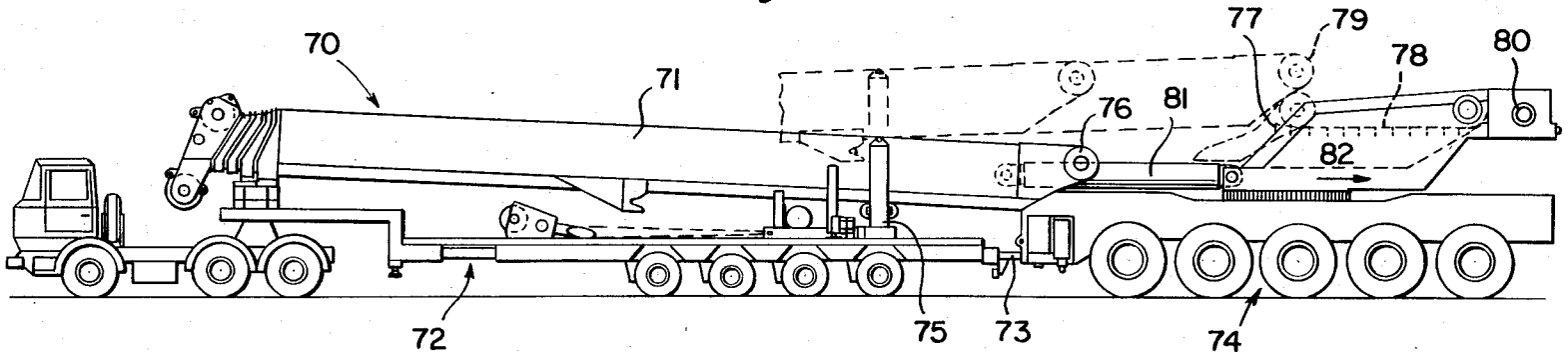
FIG. 9 is a view that is similar to FIG. 3 and illustrates the operation by which the telescopic boom of FIG. 8 is coupled.

The design of the telescopic crane shown in FIGS. 8 to 10 is basically similar to the design shown in FIGS. 1 to 7 but is smaller in size so that it is not necessary to provide a plate that is pivoted to the outer telescoped part 71 of the telescopic boom 70 and carries a diesel engine, a hydraulic pump and an auxiliary winch.

When the rear end of the crane vehicle 74 has been coupled by the coupling rod 73 to the rear end of the boom vehicle 72, the lifting structure 75 is operated to raise the boom assembly to the position shown in dotted lines in FIG. 9. The intermediate part of the three telescoped parts of the boom is locked to a cooperating coupling device of the boom vehicle 72. When the hydraulic parts of the boom vehicle 72 have been connected to the hydraulic pump carried by the crane vehicle 74, the intermediate part of the boom is telescopically extended so that the outer boom part 71 is moved beyond the rear end of the boom vehicle 72. The outer boom part 71 is provided at its lower end on both sides with rollers 76, which are placed behind the noses 77 on the slide tracks 78 carried by the revolving superstructure 82 mounted on the crane vehicle 74. As soon as the lower end of the outer boom part 71 has been moved to a position in which the bearing eyes 79 of said part 71 register with the bearing bores 80 of the revolving superstructure mounted on the crane vehicle 74, the parts are coupled by the pivot pins in the manner which has been described. The luffing cylinder 81 is then connected to the revolving superstructure 82 carried by the crane vehicle and to the outer part 71 of the boom 70.

As is apparent from FIG. 8, the outer boom part may be pivoted to a rear stay 83, which is also transported by the boom vehicle.

Although the present invention has been shown and described in terms of a preferred embodiment, it would be appreciated by those skilled in the art that changes and modifications are possible which do not depart from the inventive concepts described and taught herein. Such changes and modifications are deemed to fall within the scope of these inventive concepts.

I claim:

1. A mobile crane having load hoisting means, said mobile crane comprising:

a wheeled crane chassis;

a superstructure rotatably mounted on said crane chassis;

a telescopic boom having a first end and a second end, said boom being adapted to be pivotably coupled to said superstructure and to be detached from said superstructure;

longitudinal extending tracks located on said superstructure for engaging said second end of said boom;

a boom vehicle for supporting and transporting said telescopic boom;

positioning means located at a forward end of said boom vehicle for receiving and retaining said first end of said telescopic boom in a stationary position relative to said boom vehicle;

a lifting structure located at a rear end of said boom vehicle for lifting and supporting said boom when mounted on said boom vehicle;

a coupling yoke located at said second end of said telescopic boom;

extending and retracting means located on said boom for displacing a part of said telescopic boom towards said crane chassis while said first end of said boom is held stationary on said boom vehicle;

said coupling yoke including bearing eyes;

said superstructure including alignment bores so that when said first end of said telescopic boom is held stationary on said boom vehicle by said positioning means and said second end of said telescopic boom is displaced by said extending and retracting means to engage said second end of said boom with said tracks, said bearing eyses are longitudinally aligned with said alignment bores; and means for connecting said telescopic boom to said superstructure when said bearing eyes and said bearing bores are aligned.

2. A mobile crane according to claim 1, further comprising a plate slidable on said tracks and being pivotably connected to said coupling yoke on a pivotable axis extending parallel to a pivotable axis of the boom and a diesel engine, hydraulic pumps and a winch being mounted on said plate.

3. A mobile crane means according to claim 1, further comprising a luffing cylinder pivotally mounted on a lower, outer part of said telescopic boom, a coupling member securing said luffing cylinder to said lower, outer part, and a receiving member coupling said luffing cylinder to said superstructure.

4. A mobile crane means according to claim 1, wherein said crane chassis includes a ramp mounted at one end on said crane vehicle, drive means for raising and lowering said ramp to align said ramp with said tracks and said ramp terminating adjacent to said tracks of said superstructure.

5. A mobile crane according to claim 1, further comprising a winch located between arms of said coupling yoke of said telescopic boom.

* * * * *